E369Z OR 4,330,711

United States Patent [19]

Ahner et al.

[11] 4,330,711

[45] May 18, 1982

[54] CONTAINER COMBINATION FOR THE TRANSPORTATION AND STORAGE OF RADIOACTIVE WASTE ESPECIALLY NUCLEAR REACTOR FUEL ELEMENTS

[76] Inventors: Stefan Ahner, In der Gartel 4, 6458 Rodenbach; Richard Christ, August-Bebel-Strasse 20, 6454 Bruchkobel; Dieter Klein, Heinrich-Heine-Strasse 9, 6360 Friedberg; Peter Srostlik, Hahnenkammstrasse 2, 6457 Maintal 4, all of Fed. Rep. of Germany

[21] Appl. No.: 139,666

[22] Filed: Apr. 14, 1980

[30] Foreign Application Priority Data

Apr. 14, 1979 [DE] Fed. Rep. of Germany ..... 2915376

[51] Int. Cl.[3] ..... G21F 5/00

[52] U.S. Cl. ..... 250/506

[58] Field of Search ..... 250/506, 507

[56] References Cited

U.S. PATENT DOCUMENTS

| | | | |
|---|---|---|---|
| 3,113,215 | 12/1963 | Allen | 250/506 |
| 3,230,373 | 1/1966 | Montgomery | 250/507 |
| 3,369,121 | 2/1968 | Bruno et al. | 250/506 |
| 3,780,306 | 12/1973 | Anderson et al. | 250/507 |

*Primary Examiner*—Harold A. Dixon

*Attorney, Agent, or Firm*—Cushman, Darby & Cushman

[57] ABSTRACT

For the transportation and storage of irradiated nuclear fuel elements there are needed combinations of inner and outer containers wherein the inner container should be usable for the storage of the fuel elements in correspondingly conceived fuel element storehouses without reloading, unnecessary waste of space and burden of weight on the storage support. This is obtained by a container combination in which (a) the bottom and the jacket of the outer container are so dimensioned in their thickness that they completely or preponderantly take care of the shielding function against gamma and neutron radiation, (b) the inner container is axially fixed in the outer container in such manner that the cover of the inner container and the cover of the outer container do not touch, (c) the radial position of the inner container in the outer container is fixed by a narrowing of the cross section of the inner space of the outer container proceeding downwardly to the bottom and (d) the outer wall of the inner container is made tight against the inner wall of the outer container through sealing elements.

7 Claims, 5 Drawing Figures

CONTAINER COMBINATION FOR THE TRANSPORTATION AND STORAGE OF RADIOACTIVE WASTE ESPECIALLY NUCLEAR REACTOR FUEL ELEMENTS

BACKGROUND OF THE INVENTION

The invention is directed to a container combination for the transportation and storage of irradiated fuel elements of nuclear reactors consisting of a removable inner container which also is usable by itself for the storage in correspondingly laid out fuel element storehouses and an outer container wherein the two containers in each case have their own cover.

The previous practice is to store spent fuel elements in water basins. In this case the water has the task of shielding the radiocative radiation set free in the decay and to reliably transfer to the outside the simultaneously set free heat of decay. In this case there are expensive and costly precautions required to guarantee dependable cooling.

Therefore there was also considered the dry storage of fuel elements. Thus, e.g. it has been proposed to tightly pack spent fuel elements in steel boxes, place the boxes individually in shielded cells in layered shafts and lead off the residual heat of the fuel elements from the surface of the box with ambient air by free convection.

A disadvantage of this conception of storage is that the spent fuel elements must be unloaded at the storage place from the transportation container into the storage boxes. During the unloading the fuel elements are not protected, besides defective fuel rods must be reckoned with so that there is an increased risk of setting free activity and nuclear fuels. Therefore the reload operation must be remotely controlled and take place in a hot cell. The closing of the boxes and the control of the sealing likewise can only be carried out by remote control.

An additional storage concept is described in Boldt U.S. Pat. No. 3,828,197. Here there are stored in the free air containers with high-level radioactive waste in thick walled metal containers having shielding covers. In this case also for unloading the container from the transportation container into the storage shielding a hot cell is required. This concept thus also has the same disadvantage as the previously described concept.

A further concept therefore provides for further storage of the spent fuel elements in the container employed for the transportation. In this case an unloading of the fuel element at the storage place is not required. However, a disadvantage in this container storage is that the costly and expensive transportation container during the entire storage time cannot be employed for further transportation. This storage concept consequently is very capital expensive.

Therefore there have also been described many times two part transporation containers consisting of an outer and an inner container, thus, e.g. in Blum German OS 2147133 a container combination of an inner container with shielding walls and cover for gamma rays and an outer container laid out as a pressure container. The annular gap between outer and inner container is filled with water as a medium for neutron shielding and for heat transfer. This combination container, however, has various disadvantages. Thus, e.g. in the loading in the nuclear power plant the inner container cannot remain in the outer container so that there exists the danger of contamination. Also the handling therefore deviates substantially from the loading of customary transportation containers which leads to difficulties with the loading devices and the loading personnel. The pressure container surrounds the thick walled $\gamma$ shielding and the neutron shielding. The thick walled gamma shielding does not contribute to the strength but in an accident acts as an additional load factor on the outer container.

Water is necessary for the transfer of heat from the inner container to the outer container. In case of the loss of this water due to an accident the safety of the combination container is no longer guaranteed. There also exists the danger of the formation of radioactive hydrogen.

In inserting the inner container as storage container the entire $\gamma$ shielding remains on the storage container. This places an additional load on the storage structure and increases the cost of the storage concept.

Likewise in Lindsay U.S. Pat. No. 3,575,601 there is described a combination container consisting of an outer, shock resistant steel container and a plurality of shielding inserts. This container besides the previously described disadvantages has the further disadvantage that the inner insert as storage container additionally must be made tight at all places of connection of the shielding parts. Also in Smith, Jr. U.S. Pat. No. 2,935,616 there is described a multi-part container. It consists of outer shielding segments screwed together and a thin walled inner container. Since the inner container does not have a cover of its own, the insertion as storage container is not possible.

Therefore it was the problem of the present invention to provide a combination container for the transportation and the storage of spent fuel elements from nuclear reactors, consisting of a removable inner container which is also usable for its own in correspondingly laid out fuel element storehouses, and an outer container, whereby both containers in each case has its own cover. This combination container should not have the above described disadvantages, especially the inner container should make possible a dry storage of spent fuel elememts without changing the fuel elements at the storage place in a storage box and without unnecessary squandoring of space and weight load.

SUMMARY OF THE INVENTION

This problem was solved according to the invention by providing a combination container in which (a) the bottom and the jacket of the outer container are so dimensioned in their thickness that they completely or preponderantly take care of the shielding function against gamma and neutron radiation, (b) the inner container is axially fixed in the outer container in such manner that the cover of the inner container and the cover of the outer container do not touch, (c) the radial position of the inner container in the outer container is fixed by a narrowing of the cross section of the inner space of the outer container proceeding downwardly to the bottom and (d) the outer wall of the inner container is made tight against the inner wall of the outer container through sealing elements.

BRIEF DESCRIPTION OF THE DRAWINGS

In the drawings like numerals refer to like parts.

Figure 1:
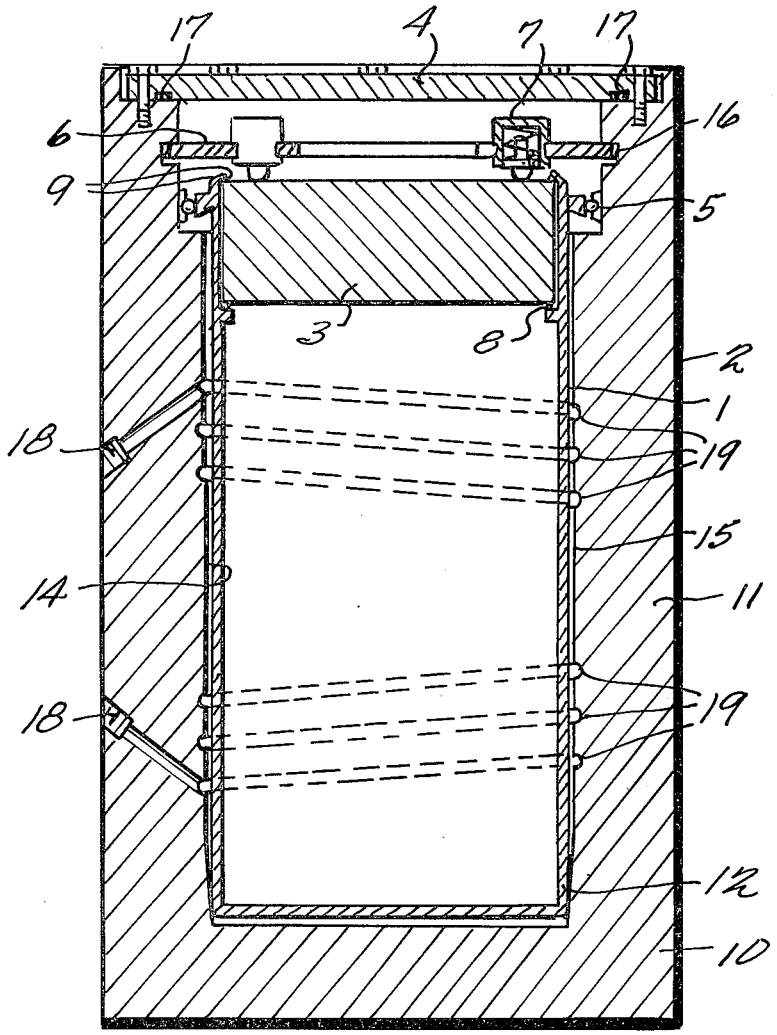
FIG. 1 is a schematic illustration of the combination container of the invention in longitudinal section.

The container combination can comprise, consist essentially of or consist of the parts set forth.

DESCRIPTION OF THE PREFERRED EMBODIMENTS

Referring more specifically to the drawings the combination container consists of a removable inner container 1 having a cover 3, which optionally consist of several component parts and an outer container 2 having a cover 4. The bottom 10 and the jacket 11 of the outer container are so dimensioned in their thicknesses that they either completely or at least preponderantly shield off the gamma and neutron radiation of the container contents from the outside. The inner container 1, moreover, is fixed axially in the outer container 2 in such a manner that the inner container cover 3 and the outer container 4 do not contact. The radial position of the inner container 1 in the outer container 2 is fixed by a narrowed cross section 12 of the inner space of the outer container 2 proceeding downwardly to the bottom 10 wherein this narrowing preferably is produced by a correspondingly wedge shaped constructed profile 13 to the outer wall 14 of the inner container 1 and the inner wall 15 of the outer container 2. The outer wall 14 of the inner container 1 is tightly sealed against the inner wall 15 of the outer container 2 by means of sealing element 5.

By dimensioning of the outer container 2 to the shielding wall thickness this container has a very high mechanical strength and so is substantially protected against damage in the case of accidents during transportation. Besides because of the omission of a heat transferring gas or liquid between inner container 1 and outer container 2 it is without pressure in normal operation so that no sealing problems occur. The heat transfer takes place over the small gap between the two containers, preferably, however, via the contacting profile 13 to the outer wall 14 of the inner container 1 and the inner wall 15 of the outer container 2. The gap between outer container 2 and the inner container 1 is so sealed through the sealing element 5 that in loading the container there cannot take place contamination of the outside of the inner container. The inner container is fixed axially in the jacket 11 of the outer container, preferably via holding down device 6, which is received in corresponding recesses 16 of the outer container jacket 11 in such manner that the cover 4 and therewith the seal 17 of the outer container 2 is not loaded.

The combination container of the invention has a relatively thin-walled inner container which is produced simply and cheaply and on a large scale, for example it is made of commercial tubular material. There are placed high requirements on a stored container in regard to the sealability. However, as is known it is difficult to carry out the customary examination such as X-ray and supersonic testing in thick walled container. With relatively thin walled containers according to the invention this test procedure causes no problem. The outer container 2 in combination with the transportation cover 4 fulfills all of the requirements for a Type B container in regard to handling mechanical integrity, heat transfer, tightness and shielding in normal transportation and in the case of accident. This outer container 2 can be made of all work materials and combination of work materials known in the practice and literature, such as wrought iron, cast iron, lead, depleted uranium, copper or synthetic resin.

Since the outer container 2 is only employed for transportation and can be utilized for a great number of inner containers 1 there is required in regard to the storage only a very limited number of the outer containers 2. Therefore there can be placed especially high requirements on the selection of material, construction, manufacture and testing without mentionably increasing the total cost of the storage. These safety reserves in the transportation are very valuable to this most risky part in the entire storage strategy.

Especial requirements are placed on the sealing in a storage container. This seal should have constant good sealing properties during the entire storage time since during the collecting of many storage containers even leak rates which are admissible for individual transportation containers would lead to the release of noteworthy activity.

Prerequisite for applying such a seal is good accessibility of the seal. The present container combination permits this accessibility in an outstanding manner through the fact that the cover 3 of the inner container 1 acts as a shielding cover. Therefore so long as the inner container 1 is still located in the outer container 2 the place of sealing is freely accessible and the permanent seal required for the storage can be installed without requiring for this purpose remote control devices and a hot cell or a water tank for radiological protection.

The inner container 1 and the shielding cover 3 additionally are made tight with a seal 8. This seal 8 above all is effective through the weight of the stationary container itself and prevents a contamination of the space between the outer container cover 4 and the inner container cover 3. Therefore it is possible to insert the permanent seal required for storage first at the place of storage.

This has the advantage that this important operation for the security of the storage always can be undertaken at a stationary device by the same crew, not every nuclear power plant must be equipped with devices and the routine loading in the nuclear power plant is not hindered.

This sealing of the gap between the inner container 1 and the outer container 2 through the seal 5 has the advantage that the inner container 1 need not be decontaminated before its insertion in the storage shield. Therefore there is not accumulated any secondary waste in the provided operation which would require additional apparatus to attend to and therewith high operating costs.

For the permanent sealing for the storage the inner container 1 and shielding cover 3 can each be provided with a welded end 9 on which they can be welded or soldered for gas tight storage.

The gap between inner container 1 and cover 3, however, can also be so formed that it can be filled with a low melting metal.

The emptying and washing of the inner container is carried out in known manner.

During the transportation the inner container 1 must be so fixed in the outer container 2 that even under conditions of an accident the transportation cover 4 and its sealing system 17 is not burdened by the inner container 1 and its content. This is solved according to the invention with a holding down device 6 at whose periphery distributed brackets fit in corresponding recesses 16 of the jacket 11 of the outer container 2 and through twisting according to the bayonnet principle is secured on the container. The security against twisting is reached through screwable tension elements 7 which simultaneously shuts the shielding cover. The tension element 7 can contain a pack of springs to compensate for the longitudinal tension of the box.

Figure 2:
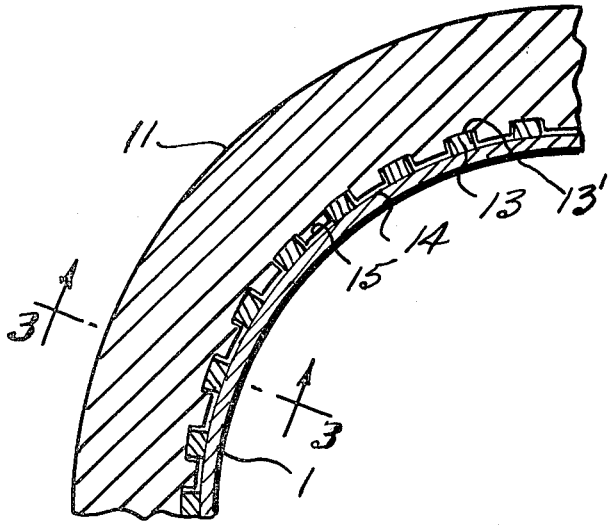
FIG. 2 is a cross-section of one form of combination container according to the invention.
Figure 3:
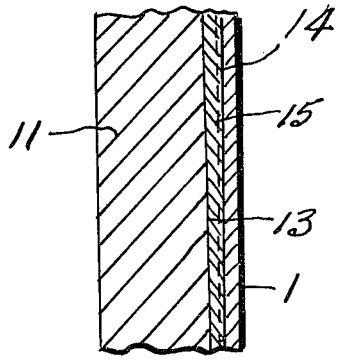
FIG. 3 is a sectional view along the line 3—3 of FIG. 2; p
Figure 4:
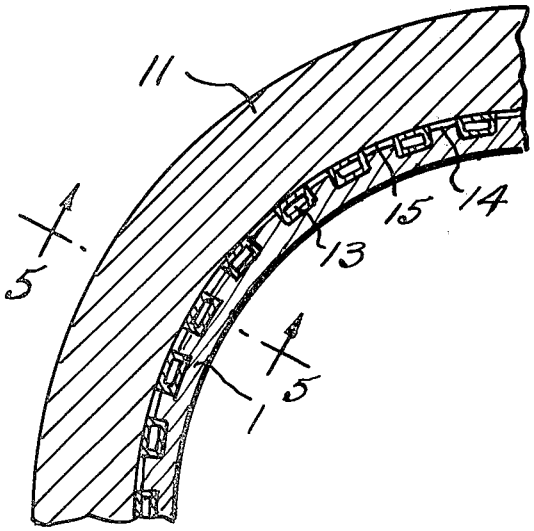
FIG. 4 is a cross-section of another form of combination container according to the invention.
Figure 5:
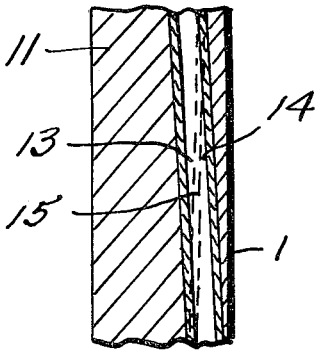
FIG. 5 is a sectional view along the line 5—5 of FIG. 4.

The outer container 2 advantageously can have cooling couplings 18 which can be joined with spirally arranged cooling channels 19 on the inner surface of the outer container 2. Thus it is possible to cool the container contents before emptying in a reprocessing plant without needing to open the inner container 1. The cooling connection 18 can also be connected to a cooling circuit during the transportation so that the fuel element temperature is lowered in the transportation. As shown in FIGS. 2–5 it is particularly advantageous to form the profile 13 hollowly on the inner wall 15 of the outer container 2 and to integrate it in the cooling circuit via the cooling channel 19.

The cover 3 of the inner container 1 can be erected of several parts and for example can consist of a thin walled true cover portion and a thick walled shielding portion. Through this the shielding portion can also be used repeatedly since it is not needed in the storage in corresponding warehousing. The heat is transferred from the inner container 1 of the outer container 2 by free convection and radiation. There is not needed an additional heat transfer medium which might fail in the case of an accident.

After the loading of the inner container 1 the inner container heats up first more quickly than the outer container 2 so that the gap between inner and outer container which is conditional by the manufacture is smaller and therewith the heat transfer is better.

Still better heat transfer is produced if the inner container 1 has wedge shaped profiles 13 (see FIGS. 2, 3) over the entire length which fit into corresponding wedge shaped profiles 13' in the outer container 2 so that there is always metallic contact between inner and outer container and therewith metallic heat conductance occurs.

The tolerance between inner and outer container is then obtained through different positions of inner and outer container and must be compensated for via seal 5.

The entire disclosure of German priority application Ser. No. P2915376.2 is hereby incorporated by reference.

What is claimed is:

1. A container combination suitable for the transportation and storage of irradiated fuel elements of nuclear reactors comprising, in combination, a removable inner container which is usable by itself for storage in a correspondingly laid out fuel element storehouse and an outer container wherein the two containers each has its own cover, each said container having a bottom and said outer container having jacket means and wherein:

(a) the thickness of the bottom and the jacket means of the outer container are such that they serve as shielding against gamma and neutron radiation;

(b) said inner container is axially fixed in said outer container with the cover of the inner container spaced from and out of contact with the cover of said outer container;

(c) said outer container and jacket means have an interior wall which taper inwardly toward said bottom of said outer container to an extent whereby the radial position of said inner container in said outer container is fixed by contact between the exterior of said inner container with at least said jacket means adjacent said bottom of said outer container; and (d) sealing means urging the outer wall of said inner container tightly against the inner wall of said outer container.

2. A container combination according to claim 1 wherein there is provided a holding down device means between the cover of the outer container and the cover of the inner container, recesses are provided in the outer container jacket means and the holding down device means is received in said recesses and can exert force on the cover of the container whereby the inner container is fixedly axially.

3. The container combination as claimed in claim 1 wherein the outer wall of said inner container is tapered adjacent its bottom to correspond to the taper on said inner wall of said outer container whereby a snug fit is obtained when said inner container is placed inside said outer container.

4. A container combination according to claim 1 wherein the jacket means has therein cooling conduit means adapted to be connected to the outside.

5. The container combination as claimed in claim 4 wherein the inner wall of said outer container is provided with a plurality of hollow recesses which are integrated into said cooling conduit means.

6. A container combination according to claim 5 wherein the cover of the inner container is so dimensioned that it provides substantially for shielding against gamma and neutron radiation.

7. A container combination according to claim 4 wherein the cover of the inner container is so dimensioned that it provides substantially for shielding against gamma and neutron radiation.

* * * * *